US012133586B2

(12) United States Patent
Zheng et al.

(10) Patent No.: US 12,133,586 B2
(45) Date of Patent: Nov. 5, 2024

(54) DROPPER PACKAGE FOR DISPENSING A FLUID PRODUCT

(71) Applicant: APR Beauty Group Inc., Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Toronto (CA)

( * ) Notice: Subject to any disclaimer, the term of this patent is extended or adjusted under 35 U.S.C. 154(b) by 396 days.

(21) Appl. No.: 17/687,842

(22) Filed: Mar. 7, 2022

(65) Prior Publication Data

US 2023/0276921 A1 Sep. 7, 2023

(51) Int. Cl.
*A45D 34/04* (2006.01)
*B65D 47/18* (2006.01)

(52) U.S. Cl.
CPC ..... *A45D 34/04* (2013.01); *B65D 47/18* (2013.01); *A45D 2200/054* (2013.01)

(58) Field of Classification Search
CPC ..... B65D 51/32; B65D 47/18; B65D 47/42; B65D 2547/00; A45D 34/04; A45D 2200/054; A61M 35/00
See application file for complete search history.

(56) References Cited

U.S. PATENT DOCUMENTS

| | | | | |
|---|---|---|---|---|
| 2014/0023425 | A1* | 1/2014 | Bonnin | A45D 40/26 401/265 |
| 2017/0079407 | A1* | 3/2017 | Chen | A45D 34/04 |
| 2017/0238673 | A1* | 8/2017 | Caulier | A45D 40/20 |
| 2018/0014624 | A1* | 1/2018 | Prade | A45D 34/042 |
| 2019/0125059 | A1* | 5/2019 | Kukreja | A45D 34/045 |
| 2020/0288842 | A1 | 9/2020 | Maurin et al. | |
| 2022/0087396 | A1* | 3/2022 | Bianco | A45D 34/04 |
| 2022/0338608 | A1* | 10/2022 | Kingswell | A45D 34/04 |
| 2023/0255339 | A1* | 8/2023 | Zheng | A45D 34/00 401/126 |

* cited by examiner

*Primary Examiner* — Cris L. Rodriguez
*Assistant Examiner* — Sydney J Pulvidente
(74) *Attorney, Agent, or Firm* — Jason Lee DeFrancesco

(57) ABSTRACT

A dropper package for dispensing and applying a fluid product, comprising a container body for storing the fluid product and a dropper assembly coupled to one end of the container body. The dropper assembly comprises a deformable bulb, a tube with its proximal end connected to the deformable bulb, and an applicator tip connected to a distal end of the tube. The applicator tip comprises a shank portion and an applying member that has two opposing main application faces. The applicator tip includes a groove on its outer surface that extends from a proximal end of the shank portion to at least a length of the applying member on one of the two opposing main application faces. The applying member is adapted to apply and dispense the fluid product in a very controlled manner as well as massage the user's keratinous surface.

20 Claims, 9 Drawing Sheets

DROPPER PACKAGE FOR DISPENSING A FLUID PRODUCT

BACKGROUND

Field of the Invention

The present disclosure relates to a dropper package for applying and dispensing a fluid product, such as cosmetic product, pharmaceutical products etc. More particularly, the present disclosure relates to a dropper package having an applicator tip for a controlled delivery of a fluid product onto the keratinous surface of the user.

Description of the Related Art

In the personal and beauty care application space, dispensers are often used to dispense products used on a user's skin, such as make-up products, beauty enhancers, serums, and other liquids. In some instances, such products may be dispensed with a conventional bulb-dropper dispenser. Conventional bulb droppers generally include a flexible bulb attached to one open end of a rigid tube. To use such a device, a user may squeeze the deformable bulb and insert the opposite open end of the rigid tube into a liquid or fluid product and release the deformable bulb. Upon release of the deformable bulb, a vacuum is formed, resulting in the drawing of liquid into the ridged tube. To dispense the liquid from the rigid tube, the user may again squeeze the deformable bulb, forcing the liquid or fluid out of the rigid tube and onto a desired surface such as the user's skin, a cloth, or other substrate. Conventional bulb-droppers have also been adapted for use with containers or bottles such that the deformable bulb-dropper also includes a collar capable of being attached to a container or bottle for storage and shipping.

Many of such dropper packages include an applicator attached to a tube for drawing product from the applicator and applying product to the user's skin, hair, etc. During, use, the dropper squeezes out the product onto the applicator's surface.

U.S. patent application "US20200288842A1" discloses a dropper including a cap connectable to a bottle; a depressible actuator coupled to the cap, a shaft coupled to the depressible actuator, wherein the shaft includes a thermal tip; wherein liquid cosmetic product is introduced into an opening in the thermal tip by depressing and releasing the depressible actuator.

In such dropper packages, when the liquid product flows out, sometimes it is difficult to control the flow of the low viscosity fluid product and they may easily drip from the applicator.

Alternative approaches to such applicators are desired. So, there is a need for a dropper package that includes an applicator that retains the fluid product, avoids dripping of the fluid product during application, and provides treatment to user's skin on both a smaller and a larger application area effectively.

SUMMARY

It is an object of the present disclosure to provide a dropper package for dispensing and applying a fluid product including a cosmetic, care, or pharmaceutical product.

It is an object of the present disclosure to provide an applicator tip that avoids dripping of the fluid product during application, offers a controlled fluid flow, is simple to use, aesthetically pleasing, and can offer massage to the keratinous surface.

Further, an applicator tip is desired which is comfortable, easier to handle and have controlled delivery onto the skin.

Accordingly there is provided a dropper package comprises a container body and a dropper assembly secured to the container body. The dropper assembly includes a cap that is connectable to the container body, a deformable bulb coupled to the cap and defining an interior chamber; a tube coupled to the deformable bulb, an applicator tip coupled to a distal end of the tube; wherein the tube has a channel that is in fluid communication with the interior chamber of the deformable bulb, the applicator tip comprises a shank portion at its upper portion and a applying member at its lower portion; wherein the shank portion is configured to connect to the tube either directly or through a connector in order to couple the applicator tip to the tube; wherein the applicator tip includes groove that extends from an upper end of the shank portion to at least along a length of the applying member of the applicator tip; the groove of the shank portion at least partially defines a dispensing channel that is in fluid communication with the channel of the tube, and wherein the dispensing channel defined by the groove terminates in a dispensing orifice formed at a proximal end of the applying member.

According to an aspect of the present disclosure, the dropper package comprises the container body and the dropper assembly secured to the container body. The dropper assembly includes the cap configured to be coupled to the container body when the cosmetic package is not in use. This dropper package extends along a longitudinal axis. The container body comprises a hollow reservoir for containing a fluid product including a cosmetic, care, or pharmaceutical product. The cosmetic, care or pharmaceutical product includes fluidic cosmetics, gloss, serum, skincare, under-eve cosmetics, pharmaceutical, and like products.

According to another aspect of the present disclosure, the dropper assembly includes a push button, the cap, an inner screw member, the deformable bulb, the tube, a connector, and the applicator tip. The tube and the applicator tip are adapted to be inserted into the container body containing the fluid product when the cap is engaged onto the container body.

According to an aspect of the present disclosure, an upper portion of the container body forms a neck portion and defines an opening at its upper end, The neck portion of the container body has screw threads formed on an outer peripheral surface thereof. The screw threads of the container body are configured to be screwed with the inner screw member of the dropper assembly to seal the container body. The inner screw member is provided at a lower inner side of the cap and has screw threads formed at an inner circumferential surface thereof The screw threads of the inner screw member are screwed with the screw threads of the container body to open and close the container body.

According to an aspect of the present disclosure, the push button is coupled to an inner upper side of the cap. The cap has an opening defined at the center of a top surface of the cap, and wherein the top surface of the cap is formed as a locking surface that surrounds the opening. When the push button is coupled to the upper inner side of the cap, the locking surface does not allow the push button to be separated from the cap. More particularly, the push button has a cylindrical upper wall and a cylindrical lower wall that is stepped out from the cylindrical upper wall. The cylindrical upper wall of the push button has a diameter lesser than the opening of the cap so that the cylindrical upper wall projects out from the opening of the cap, and the cylindrical lower wall has a diameter greater than the diameter of the opening of the cap so that the cylindrical lower wall of the push button is retained inside the cap and the push button cannot be separated from the cap.

According to another aspect of the present disclosure, a wiper is fitted into the opening of the container body. The wiper is preferably cylindrical including a central cavity. The wiper is attached to an inner periphery of the neck portion of the container body member. A wiper lip is formed at a lower end of the wiper through which the tube and the applicator tip enter and exit the reservoir, and the wiper lip serves to sweep off the extra product adhering to the tube, the connector, and the applicator tip. The wiper may include a plurality of incisions extending either radially or longitudinally or both.

In an embodiment, the wiper is made of plastic material. In various embodiments, the plastic material is selected from low-density polyethylene (LDPE), polyethylene (PE). In alternative embodiments, the wiper may be made of any other suitable material known in the art.

According to another aspect of the present disclosure, the deformable bulb is housed inside the cap, and the tube is coupled to a lower portion of the deformable bulb. The deformable bulb is preferably made of a material that is deformed by a pressing operation of the push button and then restored to its original state, in particular, natural rubber, elastomer, NBR (acrylonitrile-butadiene rubber), or silicone. The deformable bulb may be formed of one or more materials of rubber. More particularly, the deformable bulb is made of any standard appropriate oil-resistant elastic material for supporting the tube. The elastic material should exhibit a predetermined strength or elasticity and is selected from nitrile-butadiene-rubber or acrylonitrile butadiene rubber, polycarbonate, acrylic resin, or the like.

The deformable bulb is housed inside the cap such that an upper portion of the deformable bulb is located inside the push button. An upper portion of the tube is received inside the deformable bulb. The deformable bulb has a fastening groove formed in an inner side thereof at a lower portion of the deformable bulb and a locking projection is formed at an outer surface of the tube on its upper portion, and wherein the locking projection is fixedly received within the fastening groove of the deformable bulb so that the tube is not separated from the deformable bulb. More desirably, the tube is fixedly and air-tightly coupled inside to the deformable bulb.

According to yet another aspect of the present disclosure, the applicator tip is at a lower end of the tube. The applicator tip is designed to dispense, and apply the fluid product in a controlled manner as well as massage the user's surface. In an embodiment the applicator tip is connected to the lower end of the tube through the connector for fluid product delivery onto the user keratinous surface. Further, the tube is an elongated hollow cylinder defining a channel there through for storing a predetermined amount of fluid product from the reservoir therein. The channel may be in fluid communication with an interior chamber in the deformable bulb, with a channel formed between the connector and the applicator tip, and a dispensing orifice.

According to yet another aspect of the present disclosure, the applicator tip is elongated along the longitudinal axis of the dropper package. The applicator tip comprises an upper portion and a lower portion. The upper portion of the applicator tip is formed as a shank portion and the lower portion of the applicator tip is formed as applying member that is intended to come in contact with the skin of a user for application of the fluid product. The applying member includes at least two opposing main application faces. The applicator tip further includes a groove on its outer surface that extends from a proximal end of the shank portion to at least a length of the applying member on one of the two opposing main application faces. The groove is formed in the middle of the one of the two opposing main faces.

Further, the applying member includes two opposing main application faces namely a first application face and a second application face. The first and second application faces are intended to come into contact with the skin during the use of the applicator tip in order to apply the fluid product. The groove is formed in the middle of the first application face of the applying member. The applicator tip further includes two lateral sides, namely a first lateral side and a second lateral side. The first lateral side is concavely curved along a longitudinal direction of the applying member and the second lateral side is convexly curved along the longitudinal direction of the applying member.

Furthermore, the applying member has two ends, namely a proximal end adjacent to the tube, and a distal end that is a free end. Both proximal and distal ends have a rounded shape, the radius of curvature of the proximal end being larger than the radius of curvature of the distal end.

According to an aspect of the present disclosure, the first lateral side is concave and the second lateral side is convex. The radius of curvature of the first lateral side is greater than the radius of curvature of the second lateral side. This makes it possible to obtain good convergence of the lateral sides towards the free distal end of the applying member.

Further, the applying member has a rounded cross-section extending along at least a major portion of the length of the applying member to provide increased comfort during application. The rounded cross-sections of the applying member has a circular shape, an oval, or an elliptical shape with or without a notch that is defined by the groove. The rounded cross-sectional area of the applying member extends along substantially the entire longitudinal length of the applying member. The rounded cross-sectional area extends from a large cross-sectional area adjacent proximal/upper end portion, e.g., large cross-sectional area a on the applying member, to a relatively small cross-sectional area adjacent the distal/lower end portion, e.g. small cross-sectional area on the applying member. The applicator tip may have any suitable shape and size as long as it has a groove that extends from the shank portion to at least a length of the applying member on one of the two opposing main application faces.

The applying member has axially asymmetrical smooth curves, that is to say, may be selected to have an offset towards one side, having a shape like a mango. The body of the applying member tapers towards the distal end of the applying member and wherein a distal end portion of the applying member makes an angle with the longitudinal axis of the package. In other words, the distal end of the applying member does not lie on the longitudinal axis and is off-centered.

Further, the outer edges of the groove form a curved profile that is curved longitudinally. The groove tends accumulate the product dispensed out from the tube to prevent dripping of the fluid product from the applying member. In alternate embodiments, the groove may be of any shape and may or may not extend rectilinearly on the applying member. Further, the groove preferably may have a C-shaped or a J-shaped cross-sectional shape. In alternate embodiments, the groove may have any other desirable cross-sectional shape.

In a preferred embodiment, the applicator tip is made of a thermal material that can retain heat and provide a cooling sensation upon contact with the user's skin. The thermal material preferably is ceramic. In alternate embodiments, the applicator tip may be made of glass, steel, ceramic, stone, or metals, wherein the metal is selected from but not limited to silver, stainless steel, platinum, aluminum, gold, copper, brass, nickel, and alloys thereof in yet another alternate embodiment, the applicator tip may not be made from a thermal material and may be made of a plastic or any other suitable material known in the art. Further, in exemplary embodiment, the applying member is free from flocking. However, in alternate embodiments, the applying member may be at least partially flocked.

According to yet another aspect of the present disclosure, the groove extends over more than a quarter of the width of the applying member as well as over more than a quarter of its length. This dimension is suitable for storing the fluid product. The groove is spaced from the distal end of the applying member. It has a maximum depth on the applying member of dimension such that it is easier to empty the groove on contact with the skin. The maximum depth of the groove on the applying member is less than 3 mm, preferably between 1 mm to 2.5 mm. The dimensions of the groove can be chosen as a function of the quantity of fluid product which it is desired to have optionally retained. Preferably, the dimensions of the groove and of the applying member are the following, the maximum width of the groove on the first application face, measured perpendicular to the longitudinal axis of the applicator tip, is between 1 mm and 4 mm, and preferably between 2 mm and 4 mm, the maximum length of the groove on the first application face, measured along the longitudinal axis of the applicator tip is between 5 mm and 12 mm, and preferably between 6 mm and 10 mm. The maximum width of the applying member, measured perpendicular to the longitudinal axis of the applicator tip on one of the two opposing main application face is between 5 mm and 15 mm, and preferably between 7 mm and 10 mm, the length of the applying member, measured along the longitudinal axis of the applicator tip, is between 10 mm and 18 mm, and preferably between 11 mm and 15 mm. The maximum thickness of the applying member, measured perpendicular to the longitudinal axis of the applicator tip from one of the two opposing main application faces to other of the two opposing main application faces is between 5 mm and 15 mm, and preferably between 7 mm and 10 mm.

Further, the shank portion of the applicator tip is cylindrical and includes a protrusion structure on an outer periphery for coupling with the connector, According to yet another aspect of the present disclosure, the connector includes an upper portion and a lower portion. The upper portion and the lower portion both are cylindrical. The upper portion has a diameter lesser than the diameter of the lower portion of the connector. The upper portion of the connector is coupled to a lower portion of the tube and the lower portion of the connector is coupled to a shank portion of the applicator tip. The connector is hollow that defines a channel to allow the fluid product to flow through it. The fluid product can flow in and discharge out from the longitudinal channel of the tube through the channel of the connector.

Further, the connector includes at least one coupling groove and one coupling protrusion, wherein the at least one coupling groove is provided on an inner circumferential surface of the lower portion, and the coupling protrusion is provided on the outer peripheral surface of the upper portion of the connector. Additionally, both the coupling groove and protrusion can be constructed of any diameter and depth. Further, the connector may be of any shape or include various structures.

According to an aspect of the present disclosure, the applicator tip may be secured to the connector, for example, by a press-fit, snap-fit, adhesive, and/or engagement by one or more engagement features or by any other means of engagement known in the art. In the exemplary embodiment, the shank portion of the applicator tip includes at least one coupling protrusion that is received in the at least one coupling groove present on the inner circumferential surface of the lower portion of the connector, in order to snap couple the applicator tip with the connector.

According to another aspect of the present disclosure, the tube includes at least one coupling groove formed on an inner periphery near the lower end portion of the tube. Further, the coupling protrusion present on the upper portion of the connector is received and fitted into the coupling groove of the tube for coupling the connector to the tube. In various embodiments, the connector may be secured to the tube by a press-fit, snap-fit, adhesive, and/or engagement by one or more engagement features or by any other means of engagement known in the art.

According to yet another aspect of the present disclosure, the groove in the shank portion creates an inner gap between an inner side of a lower portion of the tube and the shank portion, and wherein the inner gap creates a dispensing channel between the tube and the shank portion. The dispensing channel terminates in the dispensing orifice formed at the proximal end of the applying member. The dispensing orifice is thus partially defined the connector and partially by an interface between the shank portion and the applying member of the applicator tip. The fluid product in the longitudinal channel of the tube is in fluid communication with the channel formed at the upper portion of the connector and with the dispensing channel.

Intake of the fluid product inside the dispensing channel as well as the release of the fluid product is done through the dispensing orifice of the dropper assembly. Further, the fluid product released from an orifice of the applicator tip is held within the groove so that it can be applied to the skin of the user.

While using, when the push button is pressed slowly towards its lowest position, it causes the deformable bulb to deform reducing the interior volume of the chamber of the deformable bulb and ready the dropper assembly for drawing fluid product out of the container body. Releasing the push button allows the chamber of the deformable bulb to return to its original volume and shape, drawing the fluid product into the dispensing orifice and up into the channel in the tube through the dispensing channel and the channel of the connector. To dispense the drawn-in product, when the channel of the tube is already filled with a predetermined quantity of fluid, in that case, the push button is pressed slowly towards its lowest position, causing the deformable bulb to deform as a result the fluid product discharges out in a controlled manner from the dispensing orifice on the applicator tip. More particularly, when pressure is applied by the squeezing action to the deformable bulb, the fluid product in the tube is forced to dispense out through the dispensing orifice via dispensing channel for application to the user's skin. The fluid product released from the dispensing orifice comes directly onto the groove of the applicator tip that prevents the fluid product from dripping and wasting.

A dropper package according to a second embodiment of the present disclosure may comprise an applicator tip that is directly connected to the tube without the use of an intermediate connector.

The container body that defines a reservoir for filling with fluid may be made of a rigid material like glass, metal, hard plastic, or any other material known in the art. However, in alternate embodiments, the container body is made of glass material. The container body material is non-reactive with the fluid product stored in the reservoir. In other implementations, the container body may be made of virtually any other material that is non-reactive or resistant to the fluid product being dispensed, such as various metals, plastics, glass, composites, or the like.

According to an aspect of the present disclosure, the cosmetic package, is of an elongated cylindrical configuration. However, in alternate embodiments, the cosmetic package, may be of an elongated square, polygonal configuration, oval, triangular, heart, or any other configuration known in the art.

According to an embodiment, the cap may be made of a rigid material like metal, hard plastic, or any other material known in the art. However, in alternate embodiments, the cap may be made of a rigid thermoplastic material like acrylonitrile-butadiene-styrene (ABS); polyethylene (PE); polypropylene (PP), or any other material known in the art.

According to an embodiment of the present disclosure, the connector is made of plastic, wherein the plastic may be selected from the following list: thermoplastic materials; polyethylene (PE) polyethylene terephthalate (PET); polypropylene (PP); this list not being limiting. In an alternate embodiment, the connector can be made of a material selected from plastic, steel, and metal.

According to an embodiment of the present disclosure, the tube, is made of plastic, wherein the plastic may be selected from the following list: thermoplastic materials; polyethylene (PE); polyethylene terephthalate (PET); polypropylene (PP); this list not being limiting. In an alternate embodiment, the tube, can be made of a material selected from glass, metal, steel, or plastic.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modify to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
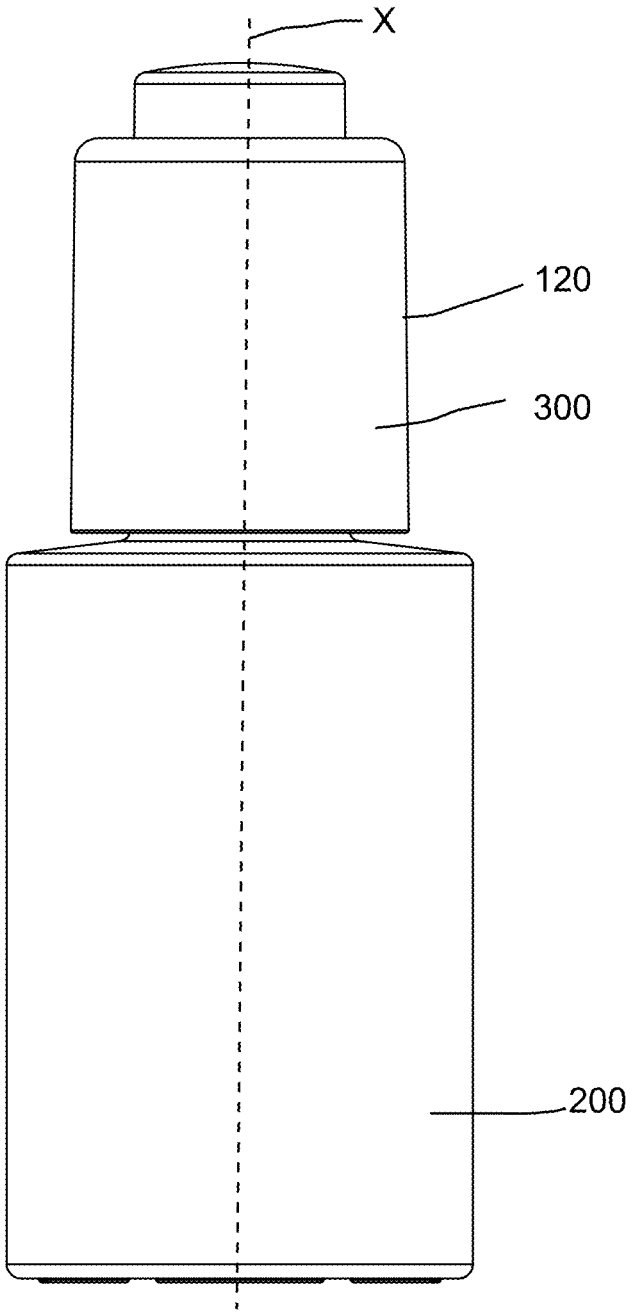
FIG. 1 illustrates a front view of a dropper package in a closed position according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

In the description of embodiments of the disclosure disclosed herein, any reference to direction or orientation is merely intended for convenience of description and is not intended in any way to limit the scope of the present disclosure. Relative terms such as "proximal," "distal," "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the package be constructed or operated in a particular orientation unless explicitly indicated as such.

Figure 3:
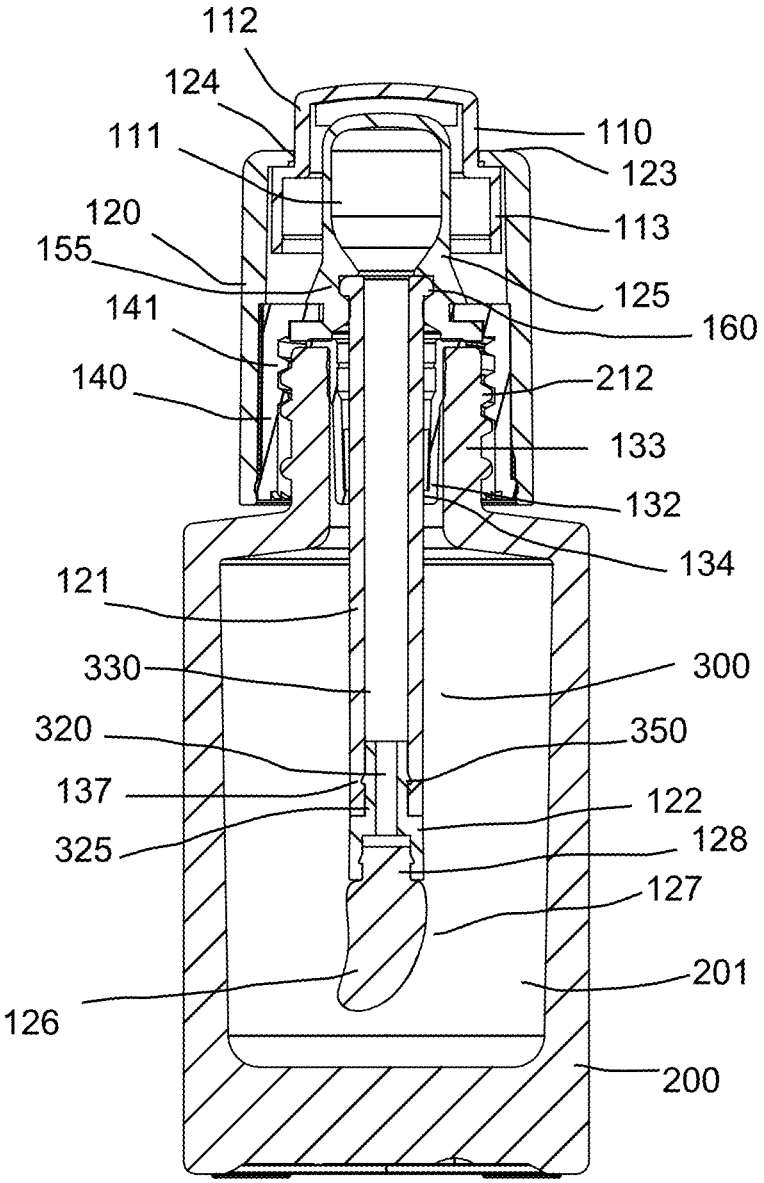
FIG. 3 illustrates a longitudinal cross sectional view of the dropper package of FIG. 1.

FIGS. 1 and 3, shows an illustrative a dropper package 100 in accordance with the present disclosure. The dropper package 100 comprises a container body 200 and a dropper assembly 300 secured to the container body 200. The dropper assembly 300 includes a cap 120 configured to be coupled to the container body 200 when the dropper package 100 is not in use. This dropper package 100 extends longitudinally along a longitudinal X-axis. The container body 200 comprises a hollow reservoir 201 (refer FIG. 3) for containing a fluid product (not shown) including a cosmetic, care, or pharmaceutical product. The cosmetic, care or pharmaceutical product includes fluidic cosmetics, gloss, serum, skincare, under-eye cosmetics, pharmaceutical, and like products.

FIG. 3 shows a cross sectional view of the dropper package 100 includes a dropper assembly 300. The dropper assembly 300 includes a push button 110, the cap 120, an inner screw member 140, a deformable bulb 125, a tube 121, a connector 122, and an applicator tip 127, as seen in the FIGS. 2-4. The tube 121 and the applicator tip 127 are adapted to be inserted into the container body 200 containing the fluid product: when the cap 120 is engaged onto the container body 200.

Figure 2:
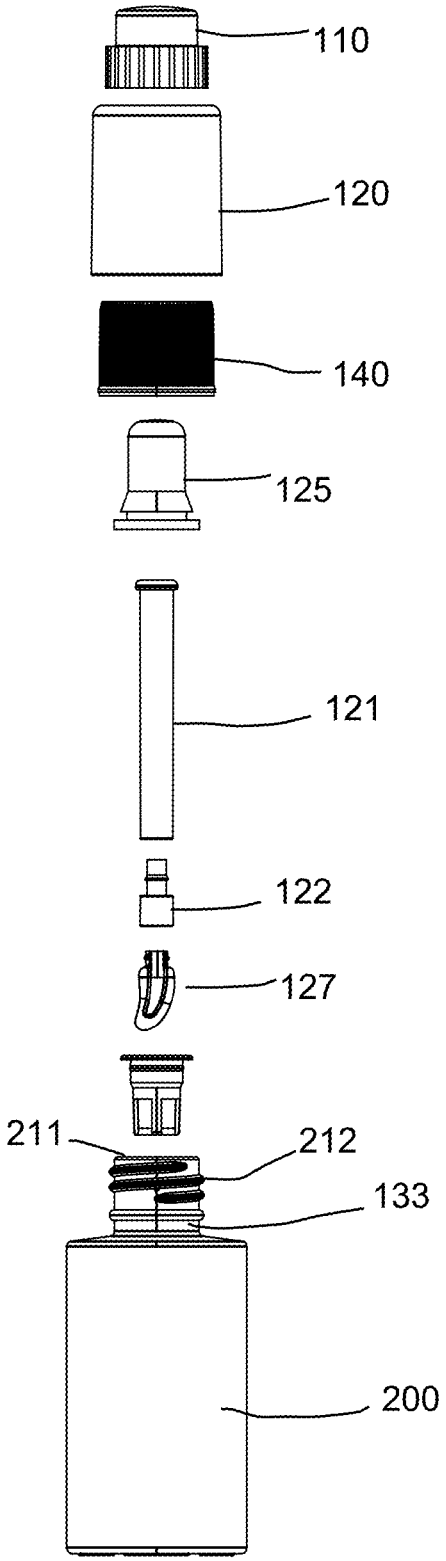
FIG. 2 illustrates an exploded view of the dropper package of FIG. 1.

Referring to FIGS. 2-3, an upper portion of the container body 200 forms a neck portion 133 and defines an opening 211 at its upper end. The neck portion 133 of the container body 200 has screw threads 212 formed on an outer peripheral surface thereof. The screw threads 212 of the container body 200 are configured to be screwed with the inner screw member 140 of the dropper assembly 300 to seal the container body 200. The inner screw member 140 is provided at a lower inner side of the cap 120 and has screw threads 141 formed at an inner circumferential surface thereof. The screw threads 141 of the inner screw member 140 are screwed with the screw threads 212 of the container body 200 to open and close the container body 200.

Referring back to FIG. 3, the push button 110 is coupled to an inner upper side of the cap 120. Furthermore, as shown, the cap 120 has an opening 124 defined at the center of a top surface 123 of the cap 120. The top surface 123 of the cap 120 is formed as a locking surface 123 that surrounds the opening 124. When the push button HO is coupled to the upper inner side of the cap 120, the locking surface 123 does not allow the push button 110 to be separated from the cap 120. More particularly, the push button 110 has a cylindrical upper wall 112 and a cylindrical lower wall 113 that is stepped out from the cylindrical upper wall 112. The cylindrical upper wall 112 of the push button 110 has a diameter lesser than the opening 124 of the cap 120 so that the cylindrical upper wall 112 projects out from the opening 124 of the cap 120, and the cylindrical lower wall 113 has a diameter greater than the diameter of the opening 124 of the cap 120 so that the cylindrical lower wall 113 of the push button 110 is retained inside the cap 120 and the push button 110 cannot be separated from the cap 120.

A wiper 132 is fitted into the opening 211 of the container body 200, as seen in FIG. 3. The wiper 132 is preferably cylindrical including a central cavity. The wiper 132 is attached to an inner periphery of the neck portion 133 of the container body member 200. A wiper lip 134 is formed at a lower end of the wiper 132 through which the tube 121 and the applicator tip 127 enter and exit the reservoir 201, and the wiper lip 134 serves to sweep off the extra product adhering to the tube 121, the connector 122, and the applicator tip 127. The wiper 132 may include a plurality of incisions either extending radially or longitudinally or both.

In an embodiment, the wiper 132 is made of plastic material. In various embodiments, the plastic material is selected from low-density polyethylene LDPE), polyethylene (PE) or any other suitable material.

Further, as shown in FIG. 3, the deformable bulb 125 is housed inside the cap 120, and the tube 121 is coupled to a lower portion of the deformable bulb 125. The deformable bulb 125 is preferably made of a material that is deformed by a pressing operation of the push button 110 and then restored to its original state, in particular, natural rubber, elastomer, NBR (acrylonitrile-butadiene rubber), or silicone. The deformable bulb 125 may be formed of one or more materials of rubber. More particularly, the deformable bulb 125 is made of any standard appropriate oil-resistant elastic material for supporting the tube 121. The elastic material should exhibit a predetermined strength or elasticity and is selected from nitrile-butadiene-rubber or acrylonitrile butadiene rubber, polycarbonate, acrylic resin, or the like.

The deformable bulb 125 is housed inside the cap 120 such that an upper portion of the deformable bulb 125 is located inside the push button 110. An upper portion of the tube 121 is received inside the deformable bulb 125. The deformable bulb 125 has a fastening groove 155 formed on an inner side thereof at a lower portion of the deformable bulb 125 and a locking projection 160 is formed at an outer surface of the tube 121 on its upper portion, and wherein the locking projection 160 is fixedly received within the fastening groove 155 of the deformable bulb 125 so that the tube 121 is not separated from the deformable bulb 125. More desirably, the tube 121 is fixedly and air-tightly coupled inside to the deformable bulb 125.

Figure 4:
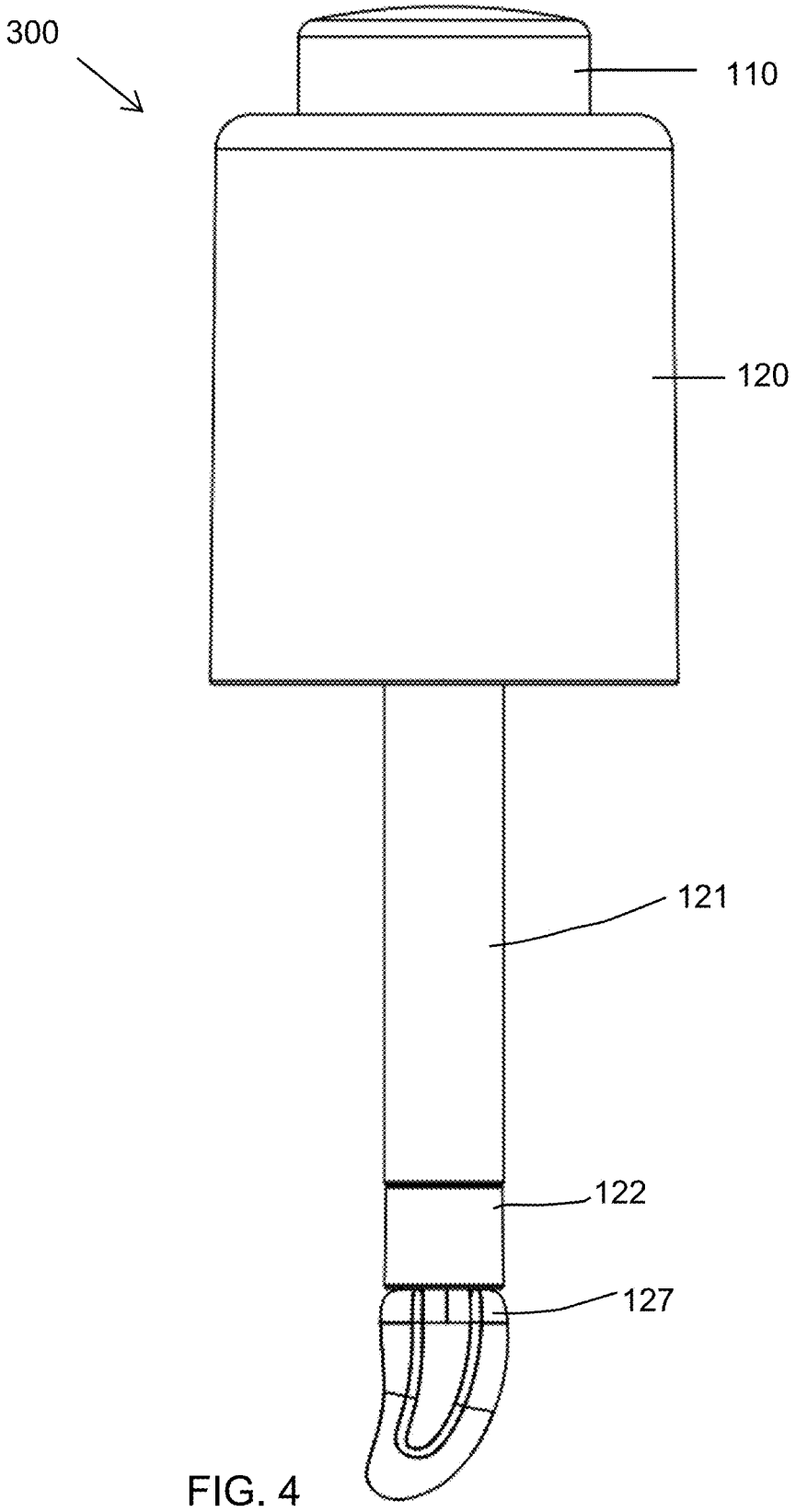
FIG. 4 illustrates an front view of an dropper assembly of the dropper package of FIG. 1.

As seen in FIGS. 3 and 4, the applicator tip 127 is present at the lower end of the tube 121. The applicator tip 127 is designed to dispense, and apply the fluid product in a controlled manner as well as massage the user's surface. In the embodiment shown, the applicator tip 127 is connected to the lower end of the tube 121 through the connector 122 for fluid product delivery onto the user keratinous surface. Further, the tube 121 is an elongated hollow cylinder defining a channel 330 there through for storing a predetermined amount of fluid product from the reservoir 20 therein. The channel 330 may be in fluid communication with an interior chamber 111 in the deformable bulb 125, with a channel 310 (refer FIG. 11) formed between the connector 122 and the applicator tip 127, and a dispensing orifice 150.

Referring to FIGS. 2 and 5-7, the applicator tip 127 is elongated along the longitudinal axis of the dropper package 100. The applicator tip comprises an upper portion and a lower portion. The upper portion of the applicator tip 127 is formed as a shank portion 128 and the lower portion of the applicator tip 127 is formed as applying member 126 that is intended to come in contact with the skin of a user for application of the fluid product. The applying member 126 includes at least two opposing main application faces **126*a*, 126*b*. The applicator tip 127 further includes a groove 450 on its outer surface that extends from a proximal end of the shank portion 128 to at least a length of the applying member 126 on one of the two opposing main application faces 126*a*, 126*b*, refer FIG. 5. The groove 450 is formed in the middle of the one of the two opposing main application faces 126*a*, 126*b***.

Figure 5:
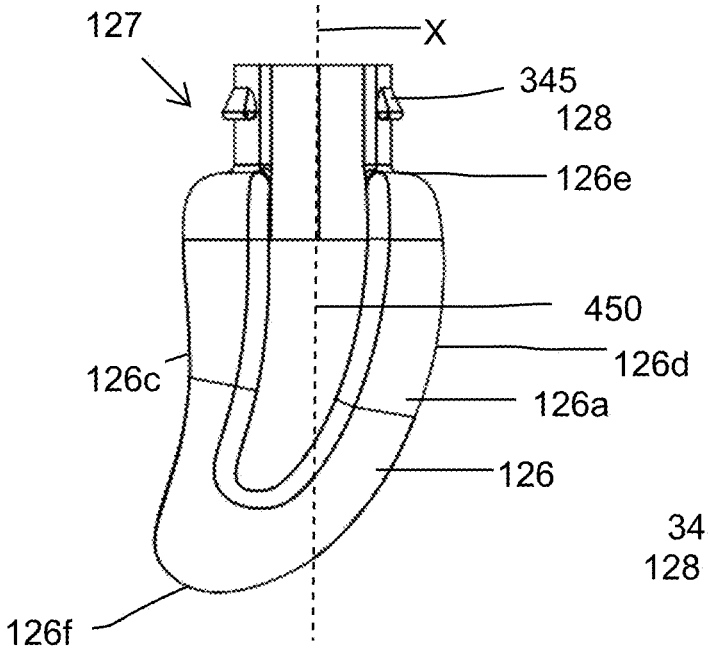
FIG. 5 illustrates a front view of au applicator tip of the dropper package of FIG. 3.
Figure 6:
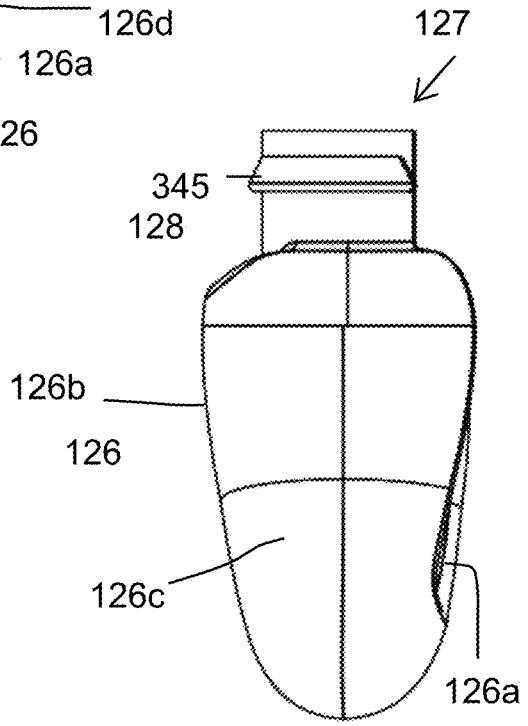
FIG. 6 illustrates a side view of an applicator tip of FIG. 5.
Figure 7:
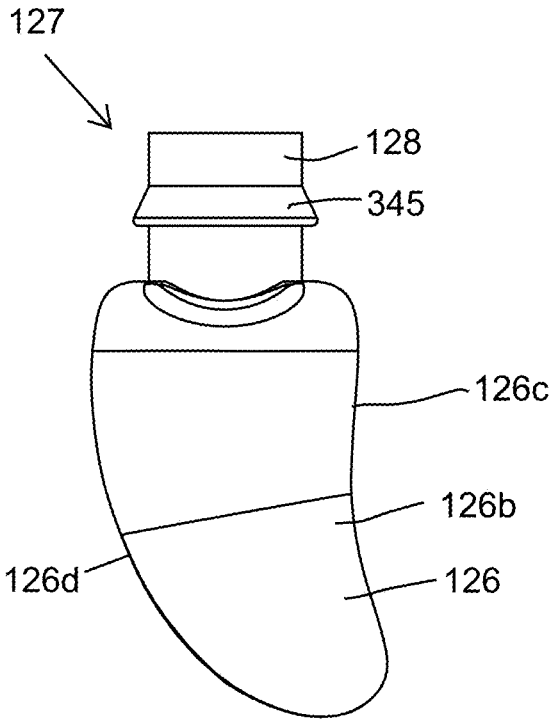
FIG. 7 illustrates a rear view of an applicator tip of FIG. 5.

As shown in FIGS. 5-7, the applying member 126 includes two opposing main application faces **126*a*, 126*b* namely a first application face 126*a* and a second application face 126*b*. The first and second application faces 126*a*, 126*b* are intended to come into contact with the skin during the use of the applicator tip 127 in order to apply the fluid product. The groove 450 is formed in the middle of the first application face 126*a* of the applying member 126. The applicator tip 127 further includes two lateral sides, namely a first lateral side 126*c* and a second lateral side 126*d*, refer FIG. 12. The first lateral side 126*c* is concavely curved along longitudinal direction of the applying member 126 and the second lateral side 126***d* is convexly curved along the longitudinal direction of the applying member 126.

As shown in FIG. 5, the applying member 126 has two ends, namely a proximal end 126*e* adjacent to the tube 121, and a free distal end 126*f*. Both proximal and distal ends 126*e*, 126*f* have a rounded shape, the radius of curvature of the proximal end 126*e* being larger than the radius of curvature of the free distal end 126*f*.

The first lateral side 126*c* is concave and the second lateral side 126 is convex. In the illustrated embodiment, the radius of curvature of the first lateral side 126*c* is greater than the radius of curvature of the second lateral side 126*d*. This makes it possible to obtain good convergence of the lateral sides 126*c*, 126*d* towards the free distal end 126*f* of the applying member 126.

Figure 13A:
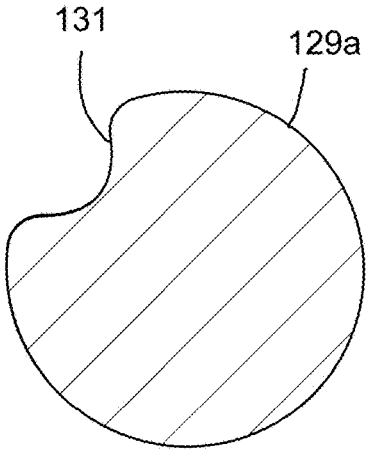
FIG. 13A illustrates a transverse cross-section of the applicator tip of FIG. 10 taken along the line A-A.
Figure 13B:
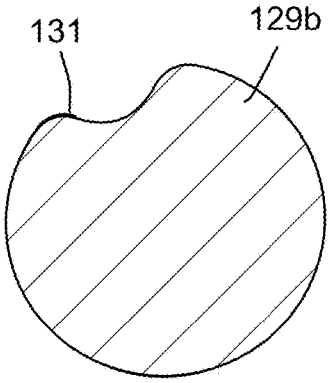
FIG. 13B illustrates a transverse cross-section of the applicator tip of FIG. 10 taken along the line B-B.
Figure 13C:
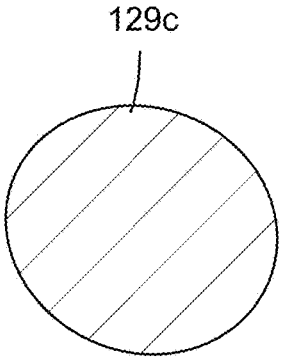
FIG. 13C illustrates a transverse cross-section of the applicator tip of FIG. 10 taken along the line C-C.
Figure 14A:
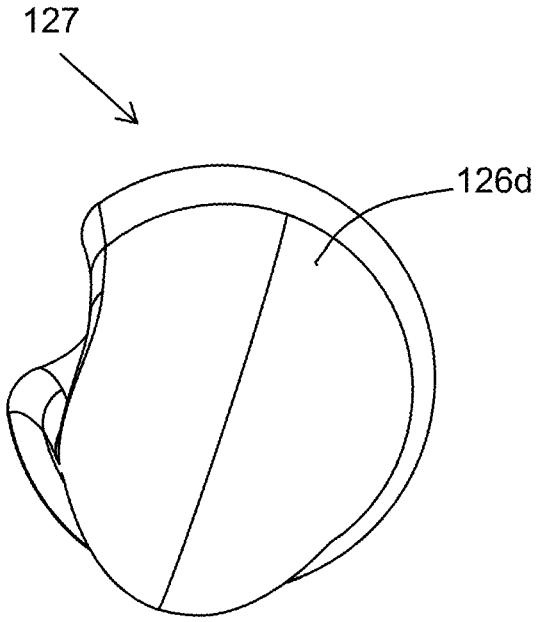
FIG. 14A illustrates a top view of the applicator tip of FIG. 5.
Figure 14B:
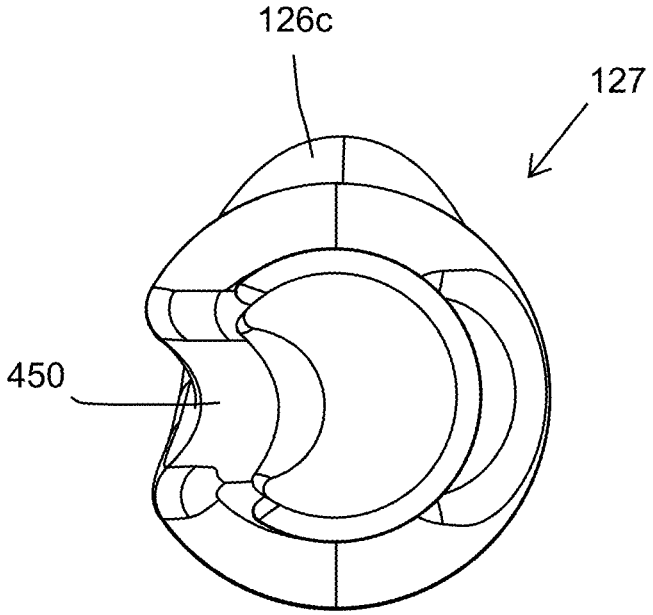
FIG. 14B illustrates a bottom view of the applicator tip of FIG. 5.

As shown in FIGS. 13A-13C, the applying member 126 has a rounded cross-section extending along at least a major portion of the length of the applying member 126 to provide increased comfort during application. As shown, the rounded cross-sections of the applying member 126 has a circular shape, an oval, or an elliptical shape with or without a notch 131 defined by the groove 450. The rounded cross-sectional area of the applying member 126 extends along substantially the entire longitudinal length of the applying member 126. The rounded cross-sectional area extends from a large cross-sectional area adjacent proximal/upper end portion, e.g., large cross-sectional area 129*a* on the applying member 126, to a relatively small cross-sectional area adjacent the distal/lower end portion, e.g. small cross-sectional area 129*c* on the applying member 126. The applicator tip 127 may have any suitable shape and size as long as it has a groove 450 that extends from the shank portion 128 to at least a length of the applying member 126 on one of the two opposing main application faces 126*a*, 126*b*.

Figure 12:
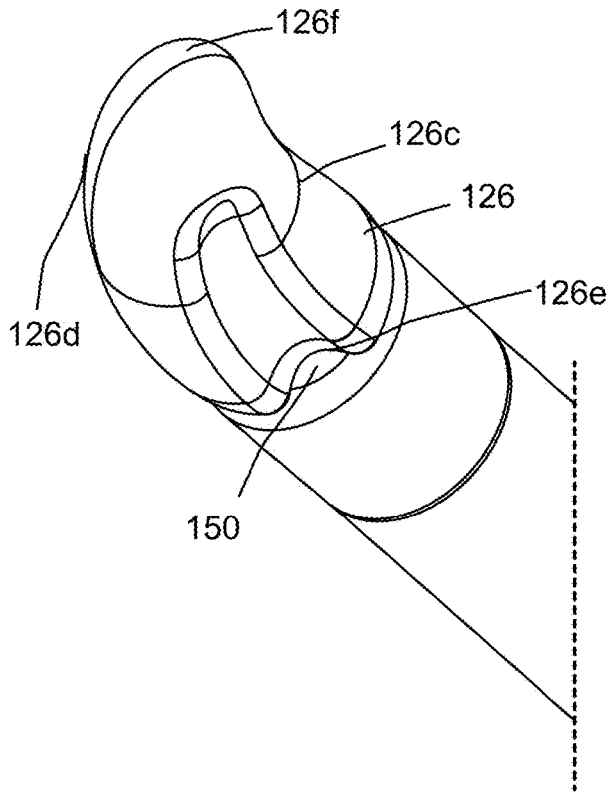
FIG. 12 illustrates a partial perspective view of the dropper assembly of FIG. 4.

The applying member 126 has axially asymmetrical smooth curves, that is to say, may be selected to have an offset towards one side, having a shape like a mango, as seen in FIGS. 5 and 12. The body of the applying member 126 tapers towards the distal end 126*f* of the applying member 126 and wherein a distal end portion of the applying member 126 makes an angle with the longitudinal axis X. In other words, the distal end 126*f* of the applying member 126 does not lie on the longitudinal axis X and is off-centered.

Further, as shown in FIG. 5, the outer edges of the groove 450 form a curved profile that is curved longitudinally. The groove 450 tends accumulate the product dispensed out from the tube 121 to prevent dripping of the fluid product from the applying member 126. In alternate embodiments, the groove 450 may be of any shape and may or may not extend rectilinearly on the applying member 126. Further, the groove 450 may have a C-shaped or a U-shaped cross-sectional shape as shown in FIG. 13A and 13B. In alternate embodiments, the groove 450 may have any other desirable cross-sectional shape.

In the present embodiment, the applicator tip 127 is made of a thermal material that can retain heat and provide a cooling sensation upon contact with the user's skin. The thermal material preferably is ceramic. In alternate embodiments, the applicator tip 127 may be made of glass, steel, ceramic, stones, or metals, wherein the metal is selected from but not limited to silver, stainless steel, platinum, aluminum, gold, copper, brass, nickel, and alloys thereof. In yet another alternate embodiment, the applicator tip 127 may not be made from a thermal material and may be made of a plastic or any other suitable material known in the art. Further, in exemplary embodiment, the applying member 126 is free from flocking. However, in alternate embodiments, the applying member 126 may be at least partially flocked.

Figure 11:
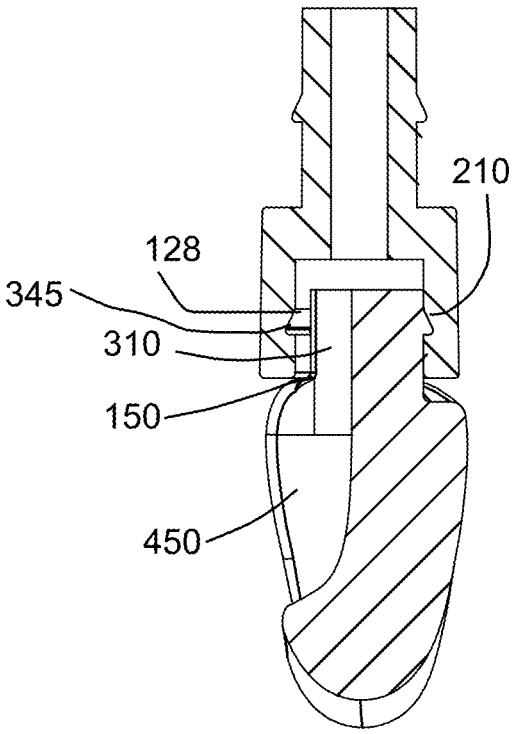
FIG. 11 illustrates a cross-sectional view of the assembly of the applicator tip and the connector of FIG. 10.

As seen in FIGS. 5-7 and 11, the shank portion 128 of the applicator tip 127 is cylindrical and includes a protrusion structure 345 on an outer periphery for coupling with the connector 122, see FIG. 11.

Referring to FIGS. 5 and 11, the groove 450 extends over more than a quarter of die width of the applying member 126 as well as over more than a quarter of its length. This dimension is suitable for storing the fluid product. The groove 450 is spaced from the distal end 126*f* of the applying member 126. It has a maximum depth on the applying member 126 of dimension such that it is easier to empty the groove 450 on contact with the skin. The maximum depth of the groove 450 on the applying member is less than 3 mm, preferably between 1 mm to 2.5 mm. The dimensions of the groove 450 can be chosen as a function of the quantity of fluid product which it is desired to have optionally retained. Preferably, the dimensions of the groove 450 and of the applying member 126 are the following, the maximum width of the groove 450 on the first application face 126*a*, measured perpendicular to the longitudinal axis X of the applicator tip 127, is between 1 mm and 4 mm, and preferably between 2 mm and 4 mm, the maximum length of the groove 450 on the first application face 126*a*, measured along the longitudinal axis X of the applicator tip 127 is between 5 mm and 12 mm, and preferably between 6 mm and 10 mm. The maximum width of the applying member 126, measured perpendicular to die longitudinal axis X of the applicator tip 127 on one of the two opposing main application faces 126*a*, 126*b* is between 5 mm and 1.5 mm, and preferably between 7 mm and 10 mm, the length of the applying member 126, measured along the longitudinal axis X of the applicator tip 127, is between 10 mm and 18 mm, and preferably between 11 mm and 15 mm. The maximum thickness of the applying member 126, measured perpendicular to the longitudinal axis X of the applicator tip 127 from one of the two opposing main application faces 126*a*, 126*b* to other of the two opposing main application faces 126*a*, 126*b*, is between 5 mm and 15 mm, and preferably between 7 mm and 10 mm.

Figure 8:
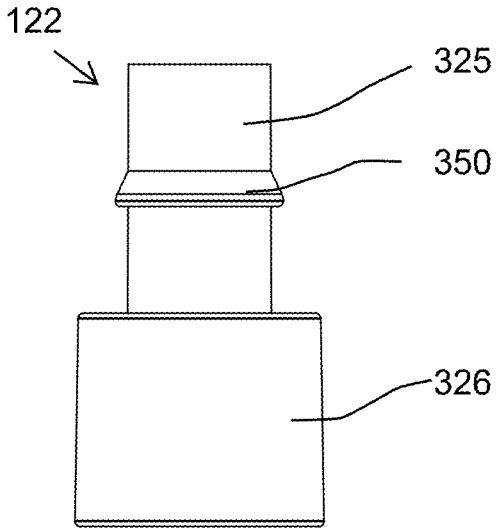
FIG. 8 illustrates a front view of an connector of the dropper package of FIG. 3.
Figure 9:
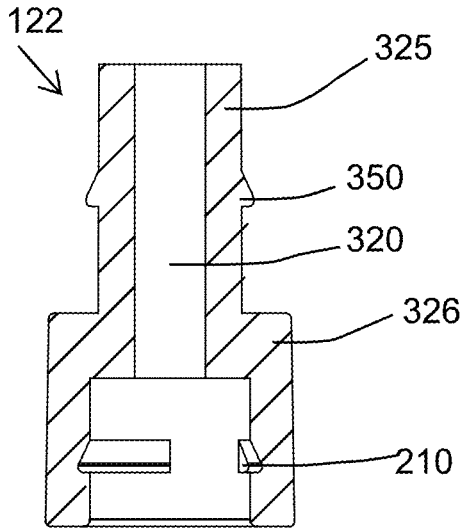
FIG. 9 illustrates a longitudinal cross-sectional view of the connector of FIG. 8.
Figure 10:
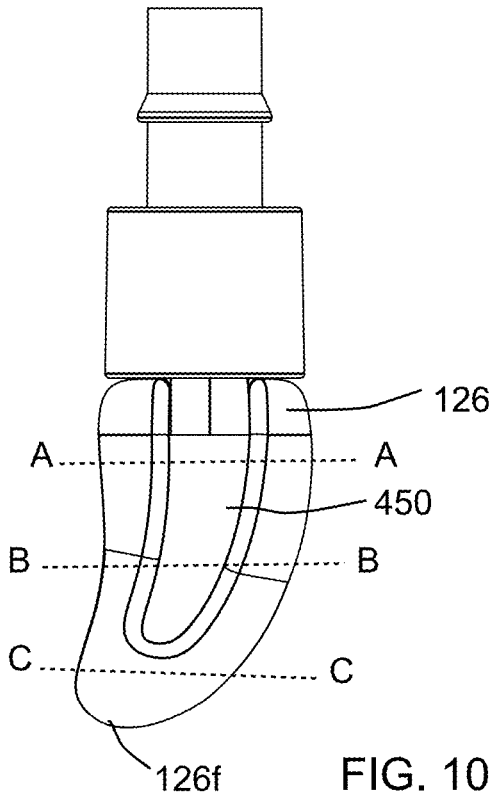
FIG. 10 illustrates a front view of an assembly comprising an applicator tip and a connector of the dropper package of FIG. 3.

Referring to FIGS. 8 and 9, the connector 122 includes an upper portion 325 and a lower portion 326. The upper portion 325 and the lower portion 326 both are cylindrical. The upper portion 325 has a diameter lesser than the diameter of the lower portion 326 of the connector 122. The upper portion 325 of the connector 122 is coupled to a lower portion of the tube 121 and the lower portion 326 of the connector 122 is coupled to a shank portion 128 of the applicator tip 127, refer FIG. 3. The connector 122 is hollow that defines a channel 320 to allow the fluid product to flow through it. The fluid product can flow in and discharge out from the longitudinal channel 330 of the tube 121 through the channel 320 of the connector 122.

Further, the connector 122 includes at least one coupling groove 210 and one coupling protrusion 350, wherein the at least one coupling groove 210 is provided on an inner circumferential surface of the lower portion 326, and the coupling protrusion 350 is provided on the outer peripheral surface of the upper portion 325 of the connector 122. Additionally, both the coupling groove 210 and protrusion 350 can be constructed of any diameter and depth. Further, the connector 122 may be of any shape or include various structures.

According to an aspect of the present disclosure, the applicator tip 127 may be secured to the connector 122, for example, by a pess-fit, snap-fit, adhesive, and/or engagement by one or more engagement features or by any other means of engagement known in the art,. In the exemplary embodiment, referring to FIGS. 11, the shank portion 128 of the applicator tip 127 includes at least one coupling protrusion 345 that is received in the at least one coupling groove 210 present on the inner circumferential surface of the lower portion 326 of the connector 122, in order to snap couple the applicator tip 127 with the connector 122.

Referring to FIG. 3, the tube 121 includes at least one coupling groove 137 formed on an inner periphery near the lower end portion of the tube 121. Further, the coupling protrusion 350 present on the upper portion 325 of the connector 122 is received and fitted into the coupling groove 137 of the tube 121 for coupling the connector 122 to the tube 121. In various embodiments (not shown), the connector 122 may be secured to the tube 121 by a press-fit, snap-fit, adhesive, and/or engagement by one or more engagement features or by any other means of engagement known in the art.

Further as seen in FIGS, 11 and 12, the dispensing channel 310 is formed by an inner gap between the inner side of the lower portion 326 of the connector 122 and the surface of groove 450 extending on the shank portion 128. The dispensing channel 310 terminates in the dispensing orifice 150 formed at the proximal end 126*e* of the applying member 126. The dispensing, or 150 is thus partially defined the connector 122 and partially by an interface between the shank portion 128 and the applying member 126 of the applicator tip 127. The fluid product in the longitudinal channel 330 of the tube 121 is in fluid communication with the channel 320 formed at the upper portion 325 of the connector 122 and with the dispensing channel 310.

Intake of the fluid product inside the dispensing channel 310 as well as the release of the fluid product is done through the dispensing orifice 150 of the dropper assembly 300. Further, the fluid product released from an orifice 150 of the applicator tip 127 is held within the groove 450 so that it can be applied to the skin of the user.

Whole in use, when the push button 110 is pressed slowly towards its lowest position, it causes the deformable bulb 125 to deform reducing the interior volume of the chamber 111 of the deformable bulb 125 and ready the dropper assembly 300 for (hawing fluid product out of the container body 200. Releasing the push button 110 allows the chamber 111 of the deformable bulb 125 to return to its original volume and shape, drawing the fluid product into the dispensing orifice 150 and up into the channel 330 in the tube 121 through the channel 310, the channel 320 of the connector 122. To dispense the drawn-in product, when the channel 330 of the tube 121 is already filled with a predetermined quantity of fluid, in that case, the push button 110 is pressed slowly towards its lowest position, causing the deformable bulb 125 to deform as a result the fluid product discharges out in a controlled manner from the dispensing orifice 150 on the applicator tip 127. More particularly, when pressure is applied by the squeezing action to the deformable bulb 125, the fluid product in the tube 121 is forced to dispense out through the dispensing orifice 150 via dispensing channels 310 and 320 for application to the user's skin. The fluid product released from the dispensing orifice 150 conies directly onto the groove 450 of the applicator tip 127 that prevents the fluid product from dripping and wasting.

Figure 15:
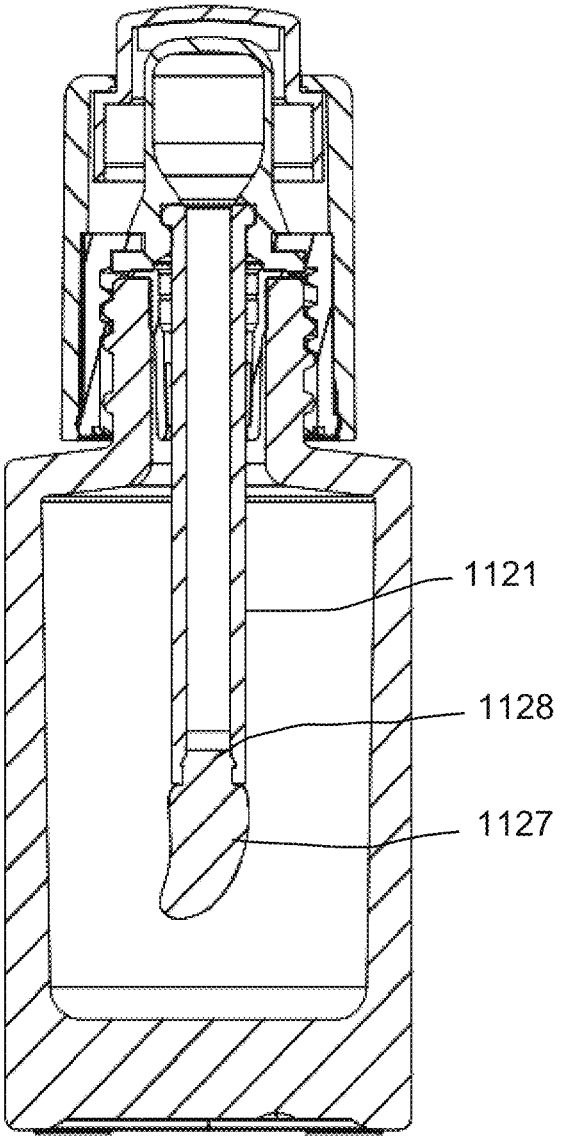
FIG. 15 illustrates a longitudinal cross sectional view of a dropper package according to second embodiment of the present disclosure.

FIG. 15 shows a dropper package 1000 according to a second embodiment of the present disclosure. The dropper package 1000 is similar to the dropper package 100 except in that an applicator tip 1127 is directly connected to the tube 1121 without the use of an intermediate connector and the groove visible in FIG. 15) in the shank portion 1128 of the applicator tip 1127 creates an inner gap between an inner side of a lower portion of the tube 1121 and the shank portion 1128; wherein the inner gap creates a dispensing channel not visible in FIG. 15) between the tube 1121 and the shank portion 1128.

The container body 200 that defines a reservoir 201 for filling with fluid may be made of a rigid material like glass, metal, hard plastic, or any other material known in the art. However, in alternate embodiments, the container body 200 is made of glass material. The container body material is non-reactive with the fluid product stored in the reservoir 201. In other implementations, the container body 200 may be made of virtually any other material that is non-reactive or resistant to the fluid product being dispensed, such as various metals, plastics, glass, composites, or the like.

According to an aspect of the present disclosure, the cosmetic package 100, 1000 is of an elongated cylindrical configuration. However, in alternate embodiments, the cosmetic package 100, 1000 may be of an elongated square, polygonal configuration, oval, triangular, heart, or any other configuration known in the art.

According to an embodiment, the cap 120 may be made of a rigid material like metal, hard plastic, or any other material known in the art, However, in alternate embodiments, the cap 120 may be made of a rigid thermoplastic material like; acrylonitrile-butadiene-styrene (ABS); polyethylene (PE); polypropylene (PP), or any other material known in the art.

According to an embodiment of the present disclosure, the connector 122 is made of plastic, wherein the plastic may be selected from the following list: thermoplastic materials; polyethylene (PE); polyethylene terephthalate (PET); polypropylene (PP); this list not being limiting. In an alternate embodiment, the connector 122 can be made of a material selected from plastic, steel, and metal.

According to an embodiment of the present disclosure, the tube 121, 1121 is made of plastic, wherein the plastic may be selected from the following list: thermoplastic materials; polyethylene (PE); polyethylene terephthalate (PET); polypropylene (PP); this list not being limiting. In an alternate embodiment, the tube 121, 1121 can be made of a material selected from glass, metal, steel, or plastic.

It will be understood that: the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A dropper package for a fluid product, the dropper package comprising:

a container body with a hollow reservoir for containing the fluid product;

a cap removably coupled to the container body;

a deformable bulb coupled to the cap and defining an interior chamber;

a tube coupled to a lower portion of the deformable bulb;

an applicator tip coupled to a distal end of the tube either directly or indirectly through a connector;

wherein the tube has a channel that is in fluid communication with the interior chamber of the deformable bulb;

wherein an upper portion of the applicator tip is formed as a shank portion and a lower portion of the applicator tip is formed as applying member that is intended to come in contact with the skin of a user for application of the fluid product;

wherein the applicator tip comprises two opposing main application faces;

wherein a groove on an outer surface of the applicator tip;

wherein the groove extends from a proximal end of the shank portion to at least a length of the applying member on one of the two opposing main application faces; and wherein a portion of the groove that extends in the shank portion is in constant: fluid communication with the channel of the tube.

2. The dropper package according to claim 1, wherein the applicator tip is made from a thermal material capable of providing a cold sensation on contact with the user's skin; and wherein the thermal material is selected from a glass, metal, stone, or ceramic.

3. The dropper package according to claim 1, wherein the dropper package comprises a dropper assembly that includes a push button, the cap, an inner screw member, the deformable bulb, the tube, the connector, and the applicator tip.

4. The dropper package according to claim 3, wherein the push button is coupled to an upper inner side of the cap; the deformable bulb is housed inside the cap, and wherein the applicator tip is connected to the distal end of the tube through the connector.

5. The dropper package according to claim 4, wherein at least one coupling groove is formed on an inner periphery near a proximal end portion of the tube; and wherein a coupling protrusion present on an outer upper portion of the connector is received and fitted into the at least one coupling groove of the tube for coupling the connector to the tube.

6. The dropper package according to claim 5, wherein the shank portion includes at least one coupling protrusion on an outer surface thereof that is received in at least one coupling groove present on an inner circumferential surface of a lower portion of the connector.

7. The dropper package according to claim 1, wherein the applicator tip is elongated along a longitudinal axis of the dropper package; and wherein the groove is formed in the middle of the one of the two opposing main application faces.

8. The dropper package according to claim 1, wherein the two opposing main application faces are namely a first application face and a second application face; wherein the applicator tip includes a first lateral side and a second lateral side; wherein the groove is formed in the middle of the first application face of the applying member.

9. The dropper package according to claim 8, wherein the first lateral side is concavely curved along a longitudinal direction of the applying member and the second lateral side is convexly curved along the longitudinal direction of the applying member; and wherein the first lateral side and the second lateral side converge towards a free distal end of the applying member.

10. The dropper package according to claim 1, wherein the applying member has a rounded cross-section along at least a major portion of the length of the applying member; and wherein the rounded cross-section of the applying member is selected from a group consisting of a circular shape, an oval, and an elliptical shape.

11. The dropper package according to claim 1, wherein the applying member tapers towards a free distal end of the applying member, and wherein the free distal end of the applying member is off-centered with respect to a longitudinal axis of the dropper package.

12. The dropper package according to claim 1, wherein the groove has outer edges that form a longitudinal curved profile on the applying member and wherein the groove has one of a C-shaped or a U-shaped cross-sectional shape.

13. The dropper package according to claim 1, wherein the groove extends over more than a quarter of the width of the applying member as well as over more than a quarter of the length of the applying member.

14. The dropper package according to claim 1, wherein the groove has a maximum depth between 1 mm to 2.5 mm; wherein a maximum width of the groove on the applying member is between 2 mm and 4 mm; wherein a maximum length of the groove on the applying member is between 6 mm and 10 mm.

15. The dropper package according to claim 1, wherein a maximum width of the applying member is between 5 mm and 15 mm, a maximum length of the applying member is between 10 mm and 18 mm; a maximum thickness of the applying member is between 5 mm and 15 mm.

16. The dropper package according to claim 1, wherein the groove in the shank portion creates an inner gap between an inner side of a lower portion of the tube and the shank portion; wherein the inner gap creates a dispensing channel between the tube and the shank portion; wherein the dispensing channel terminates at the proximal end of the applying member; wherein the dispensing channel is in fluid communication with the channel of the tube.

17. A dropper package for a fluid product, the dropper package comprising:

a container body with a hollow reservoir for containing the fluid product;

a cap removably coupled to the container body;

a deformable bulb coupled to the cap and defining an interior chamber;

a tube coupled to a lower portion of the deformable bulb;

an applicator tip coupled to a lower end of the tube either directly or indirectly through a connector;

wherein the tube has a channel that is in fluid communication with the interior chamber of the deformable bulb;

wherein an upper portion of the applicator tip is formed as a shank portion and a lower portion of the applicator tip is formed as applying member that is intended to come in contact with the skin of a user for application of the fluid product, wherein the applicator tip comprises two opposing main application faces;

wherein a groove on an outer surface of the applicator tip;

wherein the groove extends from a proximal end of the shank portion to at least a length of the applying member on one of the two opposing main application faces;

wherein the groove in the shank portion at least partially defines a dispensing channel that is in fluid communication with the channel of the tube; and wherein the applicator tip is at least partially made from a thermal material capable of providing a cold sensation on contact with the skin.

18. The dropper package according to claim 17, wherein the groove in the shank portion creates an inner gap between an inner side of a lower portion of the tube and the shank portion; wherein the inner gap creates a dispensing channel between the tube and the shank portion; wherein the dispensing channel terminates at the proximal end of the applying member;

wherein the dispensing channel is in fluid communication with the channel of the tube.

19. The dropper package according to claim 17, wherein the applicator tip is made from the thermal material capable of providing a cold sensation on contact with the user's skin; and wherein the thermal material is selected from a glass, metal, stone or ceramic.

20. A dropper package for a fluid product, the dropper package comprising:

a container body with a reservoir for containing the fluid product;

a cap removably coupled to the container body;

a deformable bulb coupled to the cap and defining an interior chamber;

a tube coupled to a lower portion of the deformable bulb;

an applicator tip coupled to a lower end of the tube;

wherein the tube has a channel that is in fluid communication with the interior chamber of the deformable bulb;

wherein an upper portion of the applicator tip is formed as a shank portion and a lower portion of the applicator tip is formed as an applying member that is intended to come in contact with the skin of a user for application of the fluid product;

wherein the applicator tip comprises two opposing main application faces;

wherein a groove extends from a proximal end of the shank portion to at least a length of the applying member on one of the two opposing main application faces; and wherein a portion of the groove that extends in the shank portion is in constant fluid communication with the channel of the tube.

* * * * *